United States Patent [19]

Carolus et al.

[11] 4,181,268

[45] Jan. 1, 1980

[54] DRIVE AND STORAGE DRUM FOR AN ANTENNA CABLE

[75] Inventors: David T. Carolus; Ralph W. Edwards, both of Dayton; John R. Powell, Bellbrook, all of Ohio

[73] Assignee: General Motors Corporation, Detroit, Mich.

[21] Appl. No.: 938,752

[22] Filed: Sep. 1, 1978

[51] Int. Cl.[2] ..... H01Q 1/10; B65H 75/34

[52] U.S. Cl. ..... 242/54 A; 343/903

[58] Field of Search ..... 343/901, 903; 242/54 A

[56] References Cited

U.S. PATENT DOCUMENTS 3,195,823 7/1965 Simmons ..... 242/54 A

*Primary Examiner*—Eli Lieberman

*Attorney, Agent, or Firm*—Donald F. Scherer

[57] ABSTRACT

A drive and storage drum is comprised of input and output frusto-conical sections. The input section has a resilient drive member and locking tangs disposed thereon which cooperate with slots disposed on the output section to provide a resilient drive connection and axial positioning between the input and output sections. An antenna cable is drivingly connected to the output section while a drive motor is drivingly connected through a worm drive to the input section. The resilient drive connection permits relative angular motion between the input and output sections when the end of cable travel is reached but the drive motor is not concurrently stopped.

2 Claims, 5 Drawing Figures

DRIVE AND STORAGE DRUM FOR AN ANTENNA CABLE

This invention relates to a drive drum for an antenna cable and more particularly to such drive drums having a resilient drive connection incorporated therein.

It is an object of this invention to provide an improved cable drive and storage drum for a power driven antenna having a resilient drive connection between the input and output members of the drum.

Another object of this invention is to provide an improved cable drive and storage drum for a power driven antenna having input and output members with cooperating frusto-conical surfaces forming a storage volume and a resilient drive connection between the members comprised of a post surrounded by an elastomeric element disposed on the input member and a slot disposed on the output member in drive relation with the elastomeric member.

A further object of this invention is to provide an improved cable drive and storage drum for a power drive antenna having input and output members with cooperating frusto-conical surfaces forming a cable storage volume, a resilient drive connection between the members and a plurality of retainer tabs extending radially from a support hub on the input member and disposed adjacent a flat interior portion of the output member to limit relative axial movement between the members.

These and other objects and advantages of the present invention will be more apparent from the following description and drawings in which.

Figure 1:
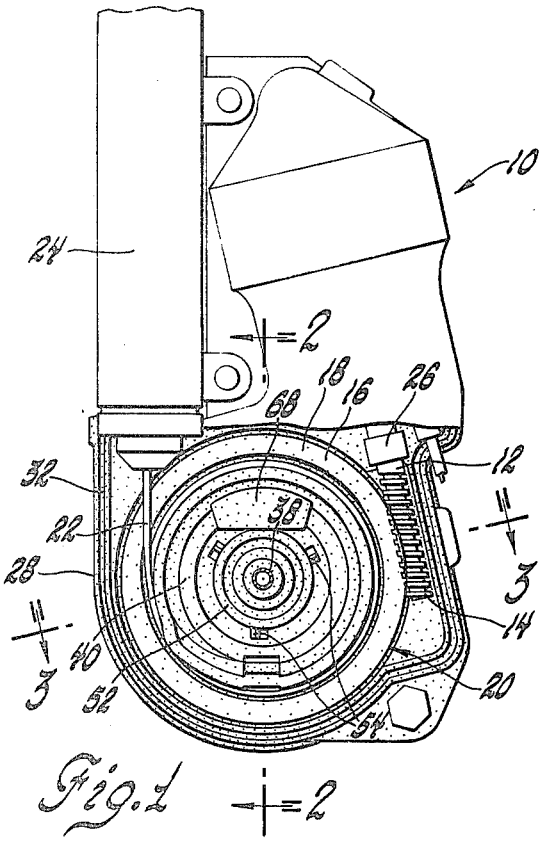
FIG. 1 is an elevational view of a portion of a power driven antenna.

Referring to the drawings, wherein like characters represent the same or corresponding parts throughout the several views, there is seen in FIG. 1, a portion of a power driven antenna having an electric drive motor disposed within a housing generally designated 10 and having an output shaft 12 on which is formed a drive worm 14. The drive worm 14 engages a worm gear 16 formed on the outer periphery of an input member 18 of a drive and cable storage drum, generally designated, 20. A cable 22 extends from the drum 20 and is connected to a conventional telescoping antenna, not shown, which is housed in a mast jacket 24 adapted to be secured to a vehicle body, not shown. A motor control reaction switch 26 is disposed between the drive motor and the worm 14 and is preferably constructed in accordance with the switch shown in United States Ser. No. 900,051, filed Apr. 26, 1978, and assigned to the assignee of the present invention.

The reaction switch 26 is operable to discontinue operation of the electric motor when the antenna reaches either full extension, full retraction or encounters an obstacle which prevents movement. Prior to the actuation of the reaction switch 26, the forces necessary to cause actuation must be transmitted through the cable 22 to the worm gear 16. Thus, the drive drum 20 must transmit these forces and must also absorb inertia forces which are present within the system. Prior art antenna drive systems have either accepted the solid connection between these components and the resulting instantaneous high load levels resulting in the use of components of sufficient strength to withstand the loads or have incorporated a drive clutch between the worm gear and the drive drum. The present invention seeks to minimize the instantaneous load levels and also eliminate a drive clutch, thus providing a more economical system.

The electric motor and drum 20 are preferably contained in a two-piece housing including a body portion 28 and a cover 30. In FIG. 1, the portion of cover 30 over the drive drum 20 and worm 14 has been removed. It should also be noted that this cover member is not shown in FIG. 2. The body portion 28 has a V-groove 32 about the periphery thereof which properly aligns the cover 30 through a corresponding V-shaped proturberance 34. For additional sealing of the cover and body, a sealant may also be added to the V-groove 32. The body 28 and cover 30 are secured together by a plurality of spring clips 36 and a rivet 38.

Figure 2:
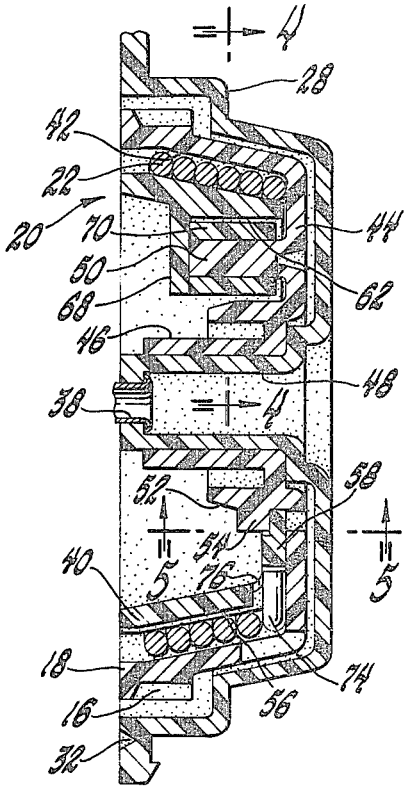
FIG. 2 is a sectional view taken along line 2—2 of FIG. 1.
Figure 3:
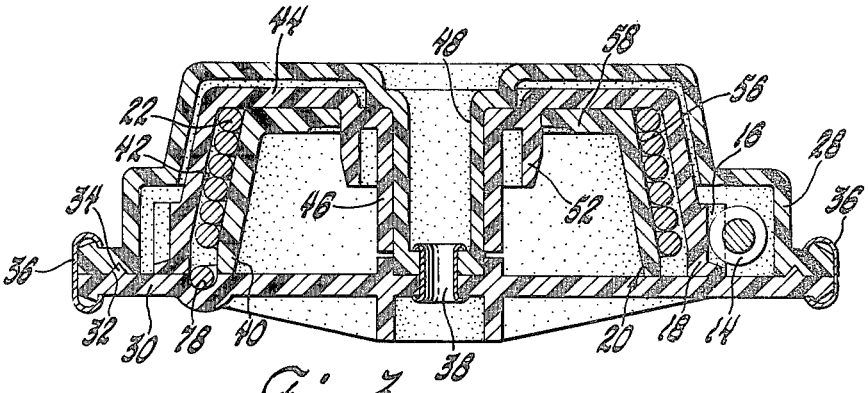
FIG. 3 is a sectional view taken along line 3—3 of FIG. 1.
Figure 4:
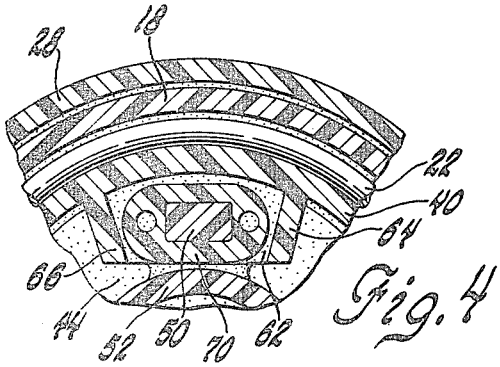
FIG. 4 is a sectional view taken along line 4—4 of FIG. 2.

The drum 20 includes the input member 18 and an output member 40. The input member 18 has a frusto-conical section 42, a substantially flat base portion 44 and a cylindrical bearing portion 46 which rotatably supports the drum 20 on a cylindrical support post 48 formed on the body 28. The input member 18 also has a drive post 50 formed integrally therewith which is substantially rectangular in cross section, as seen in FIG. 4, and extends parallel to the cylindrical bearing 46, as seen in FIG. 2. The input member 18 also has integrally formed therewith a cylindrical portion 52 which radially locates the output member 40 concentric with the input member 18. The cylindrical portion 52 has formed thereon three equally spaced retainer tabs 54 extending radially outward therefrom and axially displaced from the flat portion 44. The input member 18 and output member 40 are preferably molded in one piece and are made from a synthetic material such as glass-filled nylon.

Figure 5:
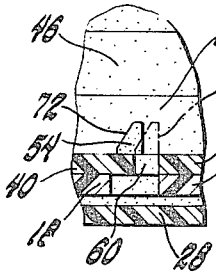
FIG. 5 is a sectional view taken along line 5—5 of FIG. 2.

The output member 40 has a frusto-conical section 56 and a flat portion 58. The flat portion 58 has three equally spaced apertures or openings 60 which may be radially aligned with the retainer tabs 54 such that, as shown in FIG. 5, the retainer tabs in phantom line will permit the output member 40 to be assembled with the input member 18 such that the flat portion 58 is disposed between the retainer tabs 54 and the flat portion 44. When the output member 40 is rotated slightly relative to the input member 18, the retainer tabs will prevent the output member 40 from moving axially relative to the input member 18. The output member 40 also has integrally formed thereon a drive slot 62 which is aligned on the drive post 50 and which slot 62 has a pair of side walls 64 and 66 extending radially inward from the frusto-conical section 56. The slot 62 also has a cover portion 68 which is formed integrally with the section 56 and the side walls 64 and 66.

An elastomeric member 70 is disposed on the drive post 50, as best seen in FIGS. 2 and 4. The elastomeric member 70 is substantially oval-shaped and when no load is being transmitted through the drum 20, is substantially centrally located in the drive slot 62. The elastomeric member 70 is fitted to the drive post 50 prior to assembly of the output member 40 onto input member 18. To align tabs 54 with the openings 60, the output member 40 is assembled with the drive slot 62 over the elastomeric member 70 and the two members are pressed together until engagement of the side of openings 60 and tapered portions 72 of retainer tabs 54 are in engagement; after which engagement further axial movement of output member 40 relative to input member 18 will cause sufficient relative angular movement and compression of elastomeric member 70 to fully align the openings 60 and retainer tabs 54 so that assembly can be completed. The resilient properties of elastomeric member 70 will cause relative angular motion to occur between the output member 40 and input member 18 such that the retainer tabs 54 are positioned above the flat portion 58 as shown in FIG. 5.

The cable 22 has one end 74 engaged in an opening 76 formed in the output member 40. The cable 22 is then coiled between the frusto-conical surfaces 42 and 56 and the other end, not shown, is connected to a telescoping antenna in a conventional manner. The cable 22 may be guided from the storage chamber between the frusto-conical surfaces to the mast jacket 24 by a groove 78 formed in the cover 30.

As previously mentioned, the reaction switch 26 is actuated at either full extension or full retraction of the antenna. When the antenna reaches either extreme position, the resistance to further movement must be transmitted through the cable 22 to output member 40, through the resilient drive connection formed by member 70, to the input member 18 which is connected to the reaction switch 26 through the worm gear 16 and worm 14. To alleviate the shock loading occasioned by the antenna reaching the end of travel position, the elastomeric member 70 will permit relative angular movement between the output member 40 and the input member 18, thus absorbing some torque and increasing the time during which the load is transmitted so that the instantaneous force loads are reduced.

As can be seen in FIGS. 2 and 5, there are openings formed in input member 18 which are axially and radially aligned with tabs 54. These openings are present to permit manufacturing of the retainer tabs integrally with the input member 18 by permitting retraction of die components which must move prior to the input member 18 being removed from the mold. It is also possible to omit cover 68 so that the elastomeric member 70 can be inserted on the post 50 after assembly of the output member 40 onto the input member 18.

Obviously, many modifications and variations of the present invention are possible in light of the above teaching. It is therefore to be understood, that within the scope of the appended claims, the invention may be practiced otherwise than as specifically described.

The embodiments of the invention in which an exclusive property or privilege is claimed are defined as follows:

1. A drive and cable storage assembly for a power driven telescoping vehicle antenna comprising; a drive cup having a frusto-conical inner surface, a flat base surface, support means extending from said base surface spaced from and encircled by said inner surface, a drive tang extending from said base surface intermediate said support means and said inner surface, and a plurality of retainer tangs integral with said support means extending radially therefrom toward said inner surface and being spaced from said base surface; a resilient member encircling said drive tang; and a driven cup having a frusto-conical outer surface generally parallel to said inner surface and spaced therefrom, a flat base portion, driven slot means having side walls extending from said base portion and being in alignment with said drive tang and said resilient member for accepting drive forces from said drive cup through said resilient member, retainer slots formed in said base portion alignable with said retainer tangs when said resilient member is compressed a predetermined amount in one direction of relative rotation between said drive tang and driven slot means and the retainer slots being maintained misaligned with said retainer tangs by said resilient member during normal operation to prevent axial separation of said drive cup and said driven cup, and antenna cable attaching slot means formed in said outer surface of said driven cup for providing a drive connection between the driven cup and an antenna cable, said space between said inner and outer surfaces providing storage space for the antenna cable when the antenna is retracted.

2. A drive and cable storage assembly for a power driven telescoping vehicle antenna comprising; an input member having a frusto-conical section, a flat base surface, support means extending from said base surface spaced from said frusto-conical section, a drive post extending from said base surface intermediate said support means and said frusto-conical section, and a plurality of retainer tangs integral with said support means extending radially outward therefrom and being spaced axially from said base surface; an elastomeric member encircling said drive post; and an output member having a frusto-conical section generally parallel to said first mentioned frusto-conical section spaced therefrom and cooperating therewith to form a cable storage space, a flat base portion, driven slot means having side walls extending from said base portion and being in radial alignment with said drive post and said elastomeric member for accepting drive forces from said input member through said elastomeric member, retainer apertures formed in said base portion of said output member alignable with said retainer tangs when said elastomeric member is compessed a predetermined amount in one direction of relative rotation between said drive post and driven slot means and the retainer apertures being maintained misaligned with said retainer tangs by said elastomeric member during normal operation to prevent axial separation of said input member and said output member, and antenna cable attaching means on said output member for providing a drive connection between the output member and an antenna cable.

* * * * *